US012551762B1

(12) United States Patent
Rife

(10) Patent No.: US 12,551,762 B1
(45) Date of Patent: Feb. 17, 2026

(54) FACE FORWARD PUTTER TYPE GOLF CLUB

(71) Applicant: Evnroll Putters, LLC, Carlsbad, CA (US)

(72) Inventor: Guerin D. Rife, Carlsbad, CA (US)

(73) Assignee: EVNROLL PUTTERS, LLC, Carlsbad, CA (US)

( * ) Notice: Subject to any disclaimer, the term of this patent is extended or adjusted under 35 U.S.C. 154(b) by 0 days.

(21) Appl. No.: 18/999,588

(22) Filed: Dec. 23, 2024

(51) Int. Cl.
*A63B 53/02* (2015.01)
*A63B 53/00* (2015.01)
*A63B 53/04* (2015.01)

(52) U.S. Cl.
CPC ..... *A63B 53/021* (2020.08); *A63B 53/007* (2013.01); *A63B 53/0487* (2013.01)

(58) Field of Classification Search
CPC .. A63B 53/021; A63B 53/007; A63B 53/0487
See application file for complete search history.

(56) References Cited

U.S. PATENT DOCUMENTS

| | | | | |
|---|---|---|---|---|
| 3,549,300 A | | 12/1970 | Pelz | |
| 4,898,387 A | * | 2/1990 | Finney | A63B 53/0487 473/341 |
| 5,078,398 A | | 1/1992 | Reed et al. | |
| 5,160,141 A | | 11/1992 | Crews | |
| 5,228,332 A | * | 7/1993 | Bernhardt | A63B 53/007 73/65.03 |
| 5,382,019 A | | 1/1995 | Sneed | |
| 5,439,222 A | * | 8/1995 | Kranenberg | A63B 53/0487 473/341 |
| 5,630,766 A | | 5/1997 | Granelli | |
| 11,779,815 B1 | | 10/2023 | Billings | |
| 11,918,869 B2 | * | 3/2024 | Parsons | A63B 53/0487 |
| 2005/0107186 A1 | * | 5/2005 | Snowdon | A63B 53/02 473/340 |
| 2024/0165466 A1 | | 5/2024 | Parsons et al. | |

FOREIGN PATENT DOCUMENTS

| | | |
|---|---|---|
| KR | 20220001111 A | 1/2022 |
| TW | 202402360 A | 1/2024 |

* cited by examiner

*Primary Examiner* — Michael D Dennis
(74) *Attorney, Agent, or Firm* — DICKINSON WRIGHT PLLC

(57) ABSTRACT

A putter type golf club includes a club head body having a striking face in a face forward position. The golf club also includes a shaft and a club grip at an upper end of the shaft. The golf club yet further includes a hosel connecting the shaft to the club head body at a heel area on a forward location of the club head body. The hosel is oriented in a reverse, onset position located behind the striking face. The hosel includes a hosel arm extending upwardly from the club head body. The hosel also includes an onset extension extending rearwardly from the hosel arm. The hosel further includes a shaft connector at an upper end of the hosel at a rearward end of the onset extension. The shaft connector is oriented at an angle to be aligned toward the center of mass of the club head body.

4 Claims, 7 Drawing Sheets

FACE FORWARD PUTTER TYPE GOLF CLUB

FIELD OF THE INVENTION

The following description relates to relates to golf putters and, in particular, to putters that are shafted to reduce twisting of the putter head during the execution of a putting stroke.

BACKGROUND

While playing the game of golf, the importance of putting the ball into a golf hole is the primary goal. Each stroke on a green, even a tap-in from an inch or two, counts the same as a 300-yard drive or a precise iron shot from many yards away. It follows that technology improvements for putter type golf clubs continue to be developed in the golf club manufacturing industry in an attempt to provide a golfer with the best chance to be a successful player of the game, particularly on the putting green where controlling distance and direction is essential to achieving lower scores. Among technical innovations, attempts have been made to structure a putter type golf club that maintains stability and minimizes face rotation during a putting stroke.

Most conventional golf putters are shafted such that in a neutral or static balanced support position (i.e., balanced on fulcrum) the putter face assumes an angle to a line that would be considered a target at which a golf ball is to be struck. It follows that a golfer is required to exert a force on the putter to align the putter face aimed at the intended target and to maintain the face alignment throughout the entire path of the putting stroke.

Stated another way, when executing the putting stroke, the golfer swings the putter back and forward making contact with a golf ball and causing it to roll toward the intended target line to the hole. Typically, this stroke will vary based on the skill of the golfer, along with various properties of the putting instrument such as the shaft angle, the weight of the putter head and the position of the hosel which connects the shaft to the putter head. Because of inertia and the natural forces of gravity, a typical conventional putter will naturally rotate varying amounts requiring the golfer to steer the face angle that contacts the golf ball in order to maintain the face on the target line to the hole.

Over the last 50 years there have been numerous attempts to create putters that reduce face angle rotation by aiming the shaft in-line with the center of mass of the putter head. In this aligned position, the weight of the putter head is evenly distributed between the heel area and toe area as well as in a front to rear direction. As a result, the putter will have a greatly reduced tendency to rotate during the execution of a putting stroke. This type of shafting is commonly referred to as low or no-torque shafting. As mentioned above, this type of putter requires that the shaft align with the center of mass of the putter head to minimize rotation of the putter head during a putting stroke.

In many original putter configurations, the shaft rose straight up from a narrow blade type putter head that was only slightly wider than the shaft. Examples of these putter structures are the original Acushnet BullsEye putters introduced in the mid-1970s or the PLOP putter introduced in the late 1990s. More recent versions of this type of shafting have been used with larger mallet style putter heads in which the center of mass is rearward of the face. These putters require that the shaft angle of the putter slants back in order to intersect with the center of mass while requiring the hands to be in the conventional position ahead of the face at address. A common drawback to this forward positioning of the hands results in a tendency to pull putts, that is, the golfer hits the ball in a direction that is left of an intended target since the hands usually rotate around the body on the forward stroke. Examples of these putters are the Edel putters, the Odyssey BackStryke and Toe-Up putter lines.

One solution that addresses the forward leaning shaft issue is to use a wide grip that has a diagonal shaft hole through the grip. This allows the hands to be in a more neutral vertical position. However, these putters with a rearward leaning shaft have a tendency to be optically difficult to aim to an intended target. Recent examples of this structure are the L.A.B. Directed Force putters and the Evnroll Zero putter, designed by the applicant of the current invention. Another putter brand called Axis One solved the forward leaning shaft issue by incorporating a weight body extending forward of the putter face with a corresponding concentration of mass on the toe area of the putter head that allowed the shaft to be aligned in a traditional vertical direction. Although allowing for the shaft to be vertical, this configuration has a significant forward weight body which is very limiting in terms of putter head design.

Other putter designs and structure of interest are shown in U.S. patents. U.S. Pat. No. 5,078,398 to Reed et al. discloses a putter with a slant neck hosel aiming the shaft directly at the center of gravity. U.S. Pat. No. 11,779,815 to Billings discloses a putter with an interchangeable hosel. U.S. Pat. No. 5,160,141 to Crews, U.S. Pat. No. 5,382,019 to Sneed, U.S. Pat. No. 5,630,766 to Granelli, Korean Patent No. KR20220001111, and Taiwan Patent No. TW202402360 all show examples of golf putters where a hosel is connected behind the face at a rear portion of the putter head. U.S. Patent Application Pub. No. 2024/0165466 to Parsons et al. shows a putter with a double bend hosel which orients the shaft axis toe-ward of the center of gravity of the putter head. U.S. Pat. No. 3,549,300 to Pelz shows a putter that is shafted at the toe.

SUMMARY OF THE DISCLOSURE

According to one aspect of the disclosure, a putter type golf club includes a club head body including a frontal ball striking face, a rear surface, a heel area, a toe area, an upper surface, and a bottom sole, wherein the club head body includes a center of gravity located on a forward one-third thereof, relative to a distance between the frontal ball striking face and the rear surface, and between the toe area and the heel area. The golf club also includes a shaft for connection to a club grip at an upper end of the shaft, the shaft extending longitudinally about a longitudinal axis of the shaft which is oriented to intersect the club head body at a location between the center of gravity and the toe area. The golf club further includes a hosel connecting the shaft to the club head body. The hosel includes an upwardly extending arm connected to the upper surface of the club head body at the heel area and between the frontal ball striking face and the rear surface. The hosel also includes an onset extension connected to a top end of the upwardly extending arm, the onset extension extending rearwardly away from the upwardly extending arm in a direction parallel to the upper surface of the club head body. The hosel further includes a shaft connector at a rearward end of the onset extension for connecting the shaft to the hosel in a position that disposes the entire shaft rearward of a plane defined by the frontal ball striking face of the club head body.

According to another aspect of the disclosure, a putter type golf club includes a club head body having a striking face in a face forward position, the club head body having a center of mass. The golf club also includes a shaft. The golf club further includes a club grip at an upper end of the shaft. The golf club yet further includes a hosel connecting the shaft to the club head body at a heel area on a forward location of the club head body. The hosel is oriented in a reverse, onset position located behind the striking face. The hosel includes a hosel arm extending upwardly from the club head body. The hosel also includes an onset extension extending rearwardly from the hosel arm. The hosel further includes a shaft connector at an upper end of the hosel at a rearward end of the onset extension. The shaft connector is oriented at an angle to be aligned toward the center of mass.

The subject matter which is regarded as the invention is particularly pointed out and distinctly claimed in the claims at the conclusion of the specification. The foregoing and other features, and advantages of the invention are apparent from the following detailed description taken in conjunction with the accompanying drawings.

DETAILED DESCRIPTION

Disclosed embodiments of the invention will be described with reference to the drawings. Although specific embodiments are described and illustrated in detail herein, one skilled in the art of golf clubs will readily ascertain additional embodiments not specifically described or illustrated to be encompassed by the invention.

Figure 1:
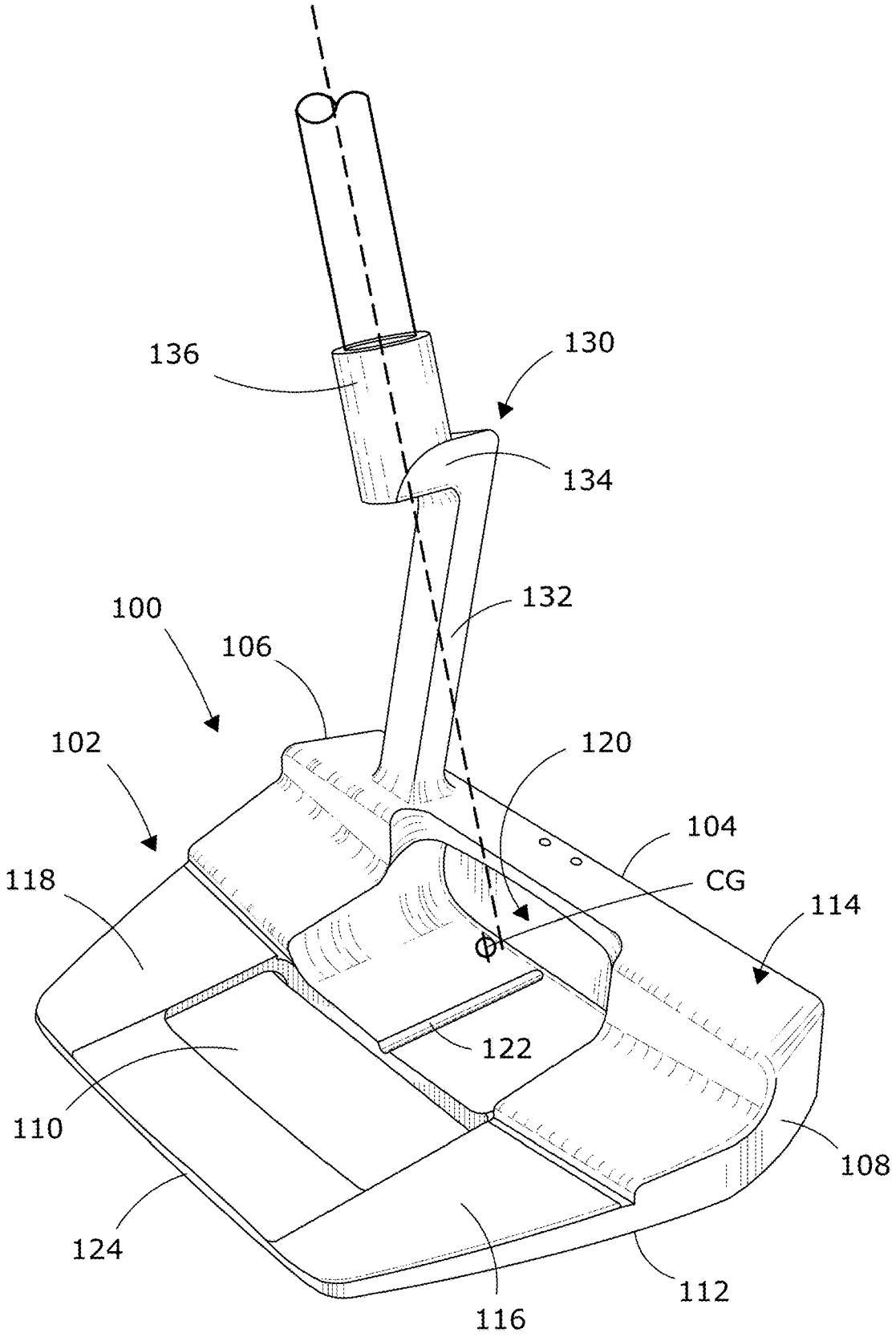
FIG. 1 is a perspective view of a putter type golf club in accordance with an aspect of the disclosure.
Figure 2:
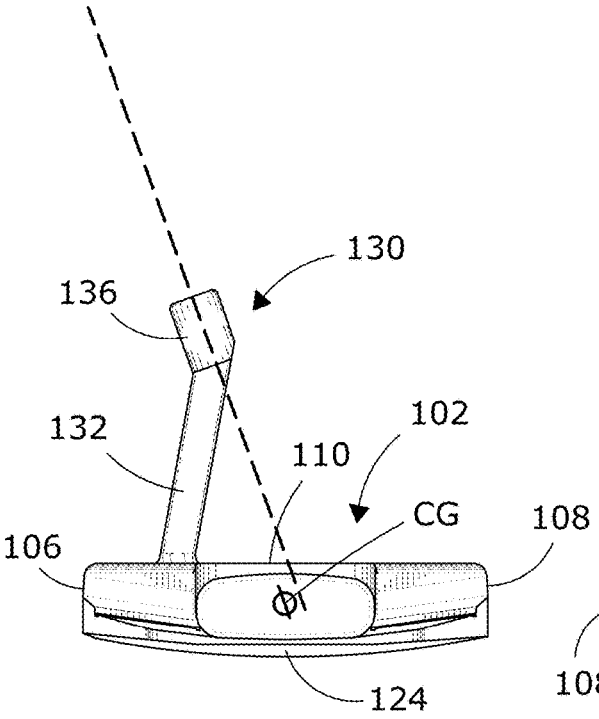
FIG. 2 is a rear perspective of the putter type golf club of FIG. 1.
Figure 3:
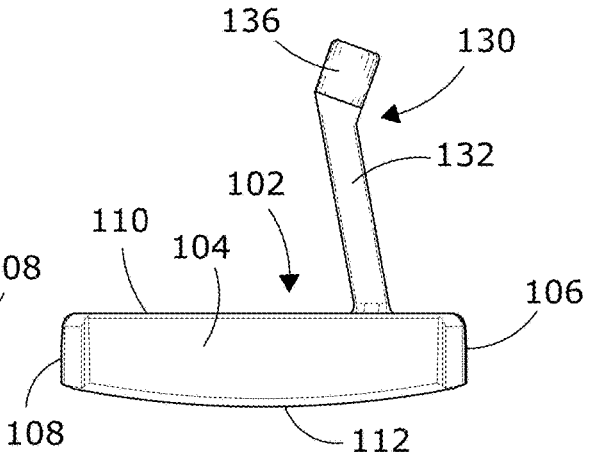
FIG. 3 is a front view of the putter type golf club of FIG. 1.
Figure 4:
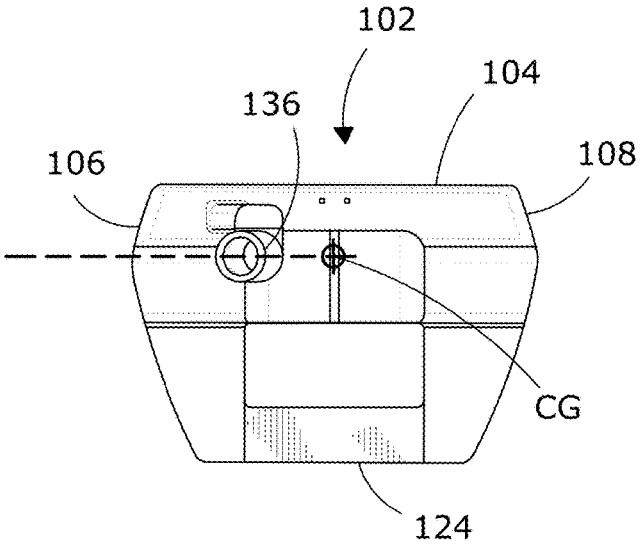
FIG. 4 is a top view of the putter type golf club of FIG. 1.
Figure 5:
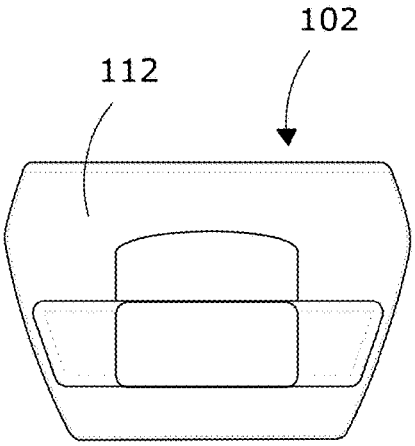
FIG. 5 is a bottom view of the putter type golf club of FIG. 1.
Figure 6:
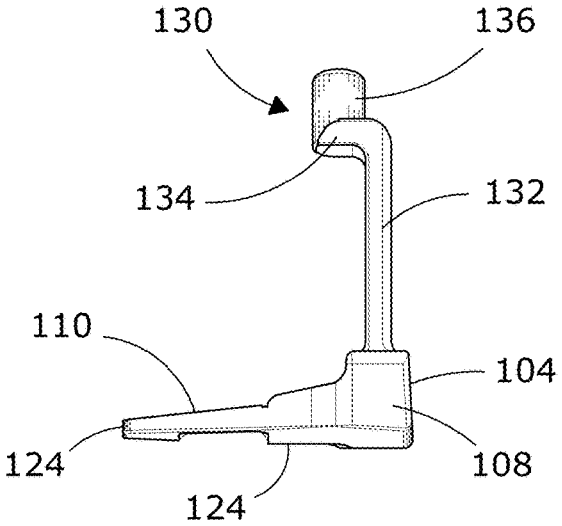
FIG. 6 is a toe side view of the putter type golf club of FIG. 1.
Figure 7:
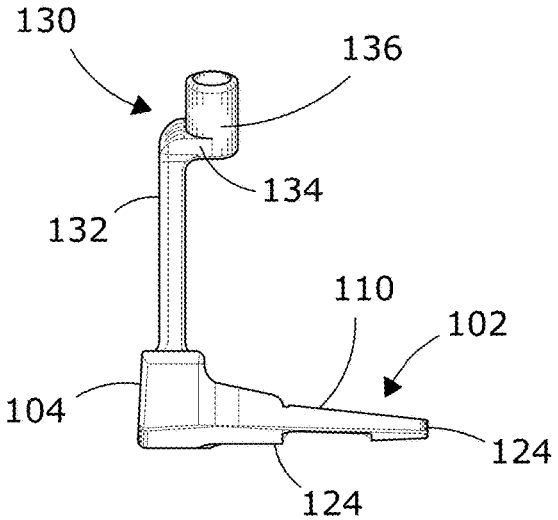
FIG. 7 is a heel side view of the putter type golf club of FIG. 1.
Figure 8:
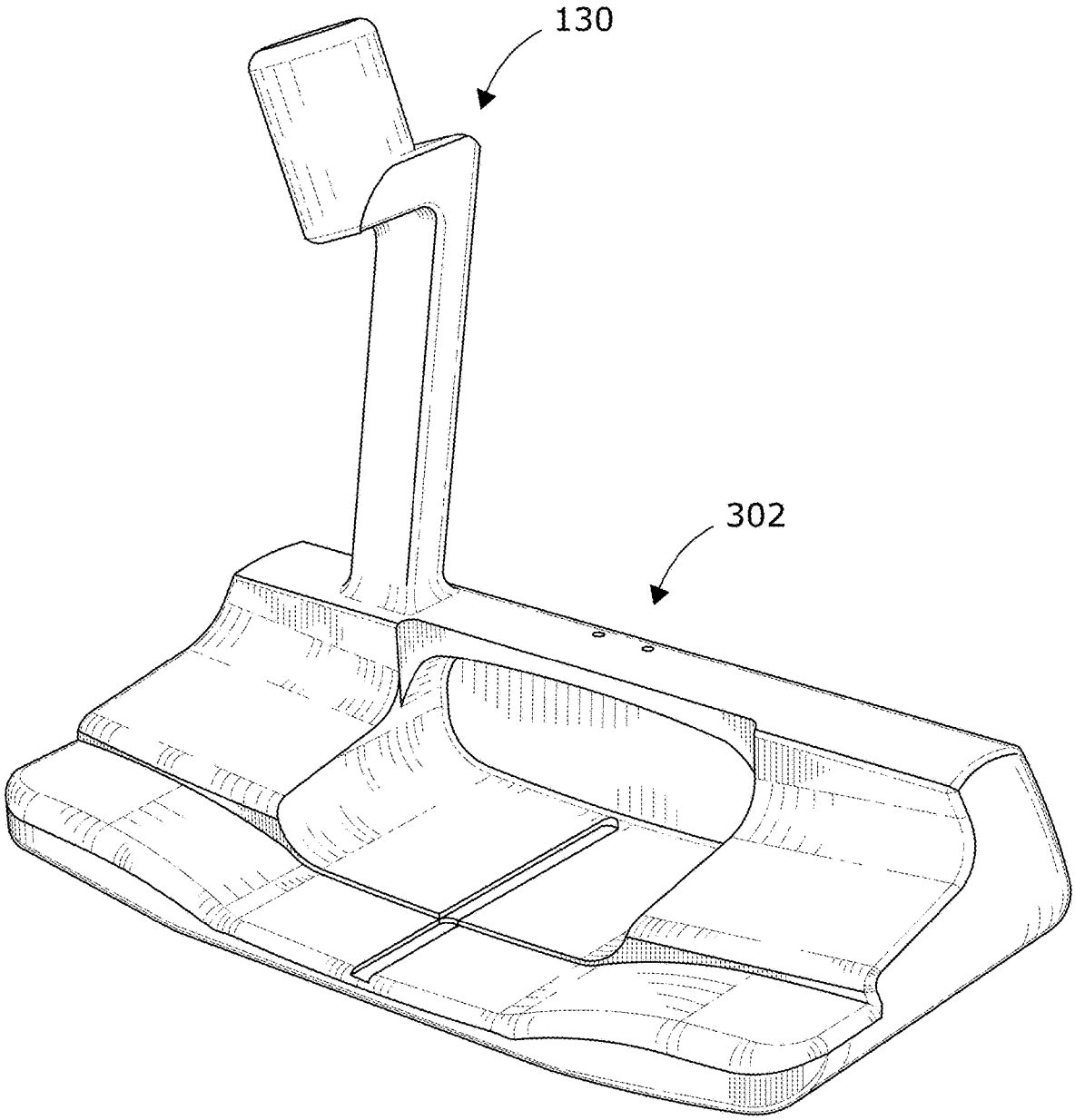
FIG. 8 is a perspective view of the putter type golf club with another type of club head.
Figure 9:
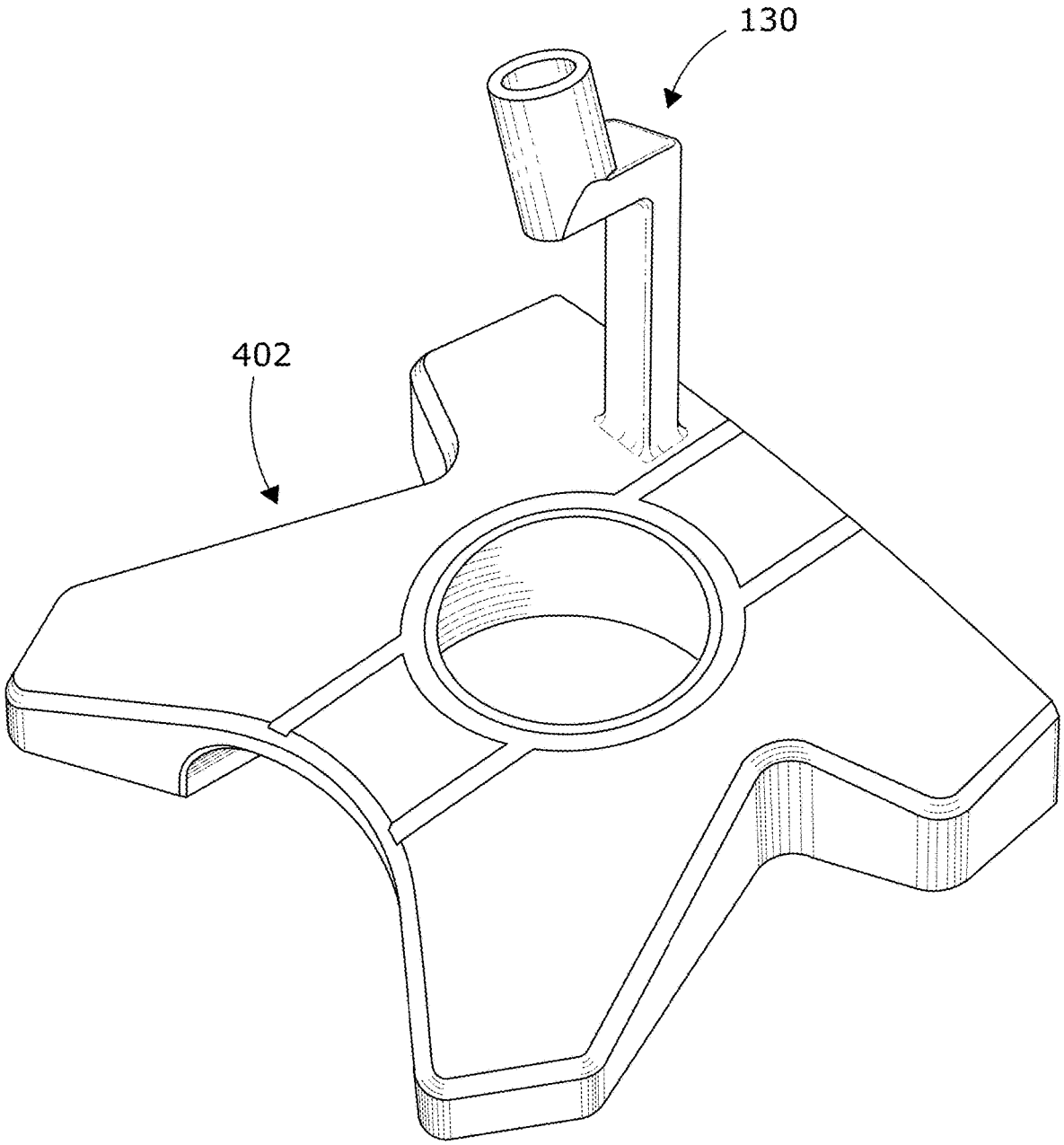
FIG. 9 is a perspective view of the putter type golf club with another type of club head.

Referring now to FIGS. 1-7, a golf type putter 100 in accordance with an embodiment of the disclosure is shown. The putter 100 has a club head body 102 having a center of gravity, referenced with CG (FIGS. 1, 2 and 4). In the illustrated embodiment of FIGS. 1-7, the club head body 102 is what is referred to as a mallet shaped club head body. However, it is to be appreciated that many other types of club head body types may benefit from the embodiments disclosed herein. In other words, the particular shape of the club head body 102 shown is illustrative only and other shapes well known in the golf putter industry may be substituted. By way of non-limiting example, a smaller club head body 302 (e.g., blade style club head body) may be included, as shown in FIG. 8, or a larger mallet club head body 402 may be utilized, as shown in FIG. 9. It is to be understood that any type of club head body may be provided as an embodiment in accordance with the invention. As such, only the embodiment of the club head body 102 of FIGS. 1-7 is described in detail herein.

The club head body 102 includes a frontal striking face 104, a heel area 106, a toe area 108, a top surface 110 and a bottom sole 112. In the illustrated embodiment, the body 102 is formed with a front mass 114 in a front third of the club head body 102, a toe side wing 116, a heel side wing 118 and a rear cavity 120 that includes an alignment line 122. A rear surface 124 of the putter 100 is formed at the ends of each of the toe side wing 116 and heel side wing 118. This structure of the putter 100 positions the center of gravity CG essentially in the center of the club head body 102 approximately halfway between the heel 106 and toe 108, and closer to the striking face 104 at the front mass 114, relative to a striking face 104 to rear surface 124 direction. In some embodiments, the center of gravity CG of the club head body 102 is located on a forward one-third of the mass thereof, relative to the striking face 104 and the rear surface 124 direction.

The putter 100 is connected to a conventional shaft 126 and grip 127 (FIG. 11) in such a way that the shaft 126 is positioned behind the striking face 104, thereby providing a "face forward" configuration. The face forward configuration is disclosed herein and results in an unobstructed view of the striking face 104, the upper surface of the club head body 102, and the cavity 120 when a golfer uses the putter 100 in a normal manner to execute a putting stroke.

The putter 100 includes a hosel 130 having a particular shape that is referred to in the industry as a plumber's neck. The hosel 130 is located proximate the heel area 106 of the club head body 102, behind the striking face 104, and between the striking face 104 and the rear surface 124, such that the putter 100 assumes a face forward configuration. In some embodiments, the hosel 130 is connected to the club head body 102 at a heel-ward one-fourth of a distance between a heel end 106 and a toe end 108 of the club head body 102. The face forward configuration refers to the striking face 104 being in front of the shaft 126 and hosel 130 when the putter 100 is in a normal position prior to and during a putting stroke. The location of the hosel 130 and the connection of the shaft 126 to the hosel 130 aligns the shaft 126 toward the center of gravity CG of the club head body 102 in a position which allows a golfer a full view of the top of the club head body 102 including any alignment features typically presented thereon. In addition, this location of the hosel 130 permits an unobstructed view of the entire striking face 104 in a full heel area 106 to toe area 108 direction.

The hosel 130 is formed by an upwardly extending arm 132 that is either permanently connected with the upper surface of the club head body 102 or is a separate piece attached at the heel area 106 of the front mass 114 of the club head body 102 using conventional attaching hardware such that the hosel arm extends upwardly from the club head body 102. The upwardly extending arm 132 extends substantially parallel to the plane defined by the frontal ball striking face 104 of the club head body 102 in some embodiments. To further define the orientation of the upwardly extending arm according so some embodiments of the disclosure, the upwardly extending arm 132 of the hosel 130 extends substantially perpendicularly relative to the upper surface of the club head body 102.

The hosel 130 further includes a rearwardly facing onset extension 134 that is generally parallel to an upper surface of the club head body 102 and which is connected to a top end of the upwardly extending arm 132.

The hosel 130 also includes a shaft connector 136 at a rearward end of the onset extension 134 for connecting the shaft 126 to the hosel 130 in a position that disposes the entire shaft 126 rearward of a plane defined by the frontal ball striking face 104 of the club head body 102. In the illustrated embodiment, the shaft connector 136 is a shaft socket that locates the shaft 126 still further behind the upwardly extending arm 132 of the hosel 130 and the striking face 104. The shaft socket 136 is at an angle such that the shaft 126 connected into the shaft socket 136 is aimed toward the center of gravity CG of the club head body 102 in such a way that the putter 100 maintains stability and direction during the execution of a putting stroke.

In particular, the hosel 130 is structured to align the shaft socket 136 and the shaft 126 connected therein in line with the center of gravity CG in a heel to toe direction and at the center of gravity CG in a front to rear direction. In some embodiments, the shaft 126 is aimed slightly toward to the toe area 108. For example, the shaft 126 extends longitudinally about a longitudinal axis of the shaft 126 which is oriented to intersect the club head body 102 at a location between the center of gravity CG and the toe area. In some embodiments, the intersection of the longitudinal axis of the shaft 126 and the club head body 102 is at or within approximately a length that is less than a diameter of the shaft 126, or no greater than a distance of 0.5 inches. The location of the shaft 126 being slightly toward the toe 108 of the putter allows the putter 100 to lie in a face forward position in a static and balanced condition particularly when balanced on a fulcrum that balances the putter weight on either side of the fulcrum.

Figure 10:
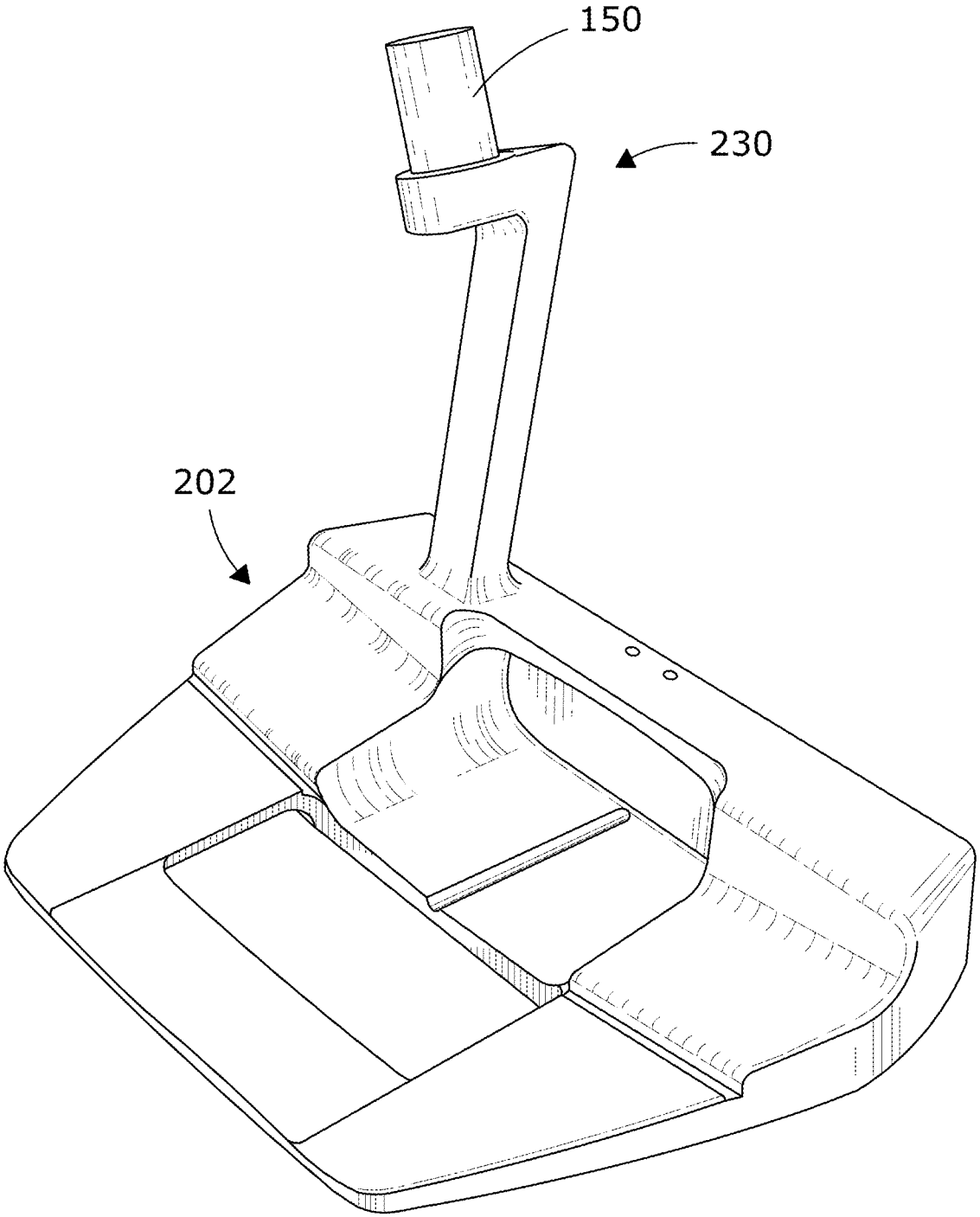
FIG. 10 is a perspective view of the putter type golf club with another type of hosel and shaft connection.

In the embodiments of FIGS. 1-9, the shaft 126 is connected to the hosel 130 using the socket 136. It will be appreciated the shaft 126 may be connected by a cylindrical, pin structure 150, as shown in FIG. 10. In such an embodiment, the pin 150 fits into the shaft opening and is permanently secured therein. FIG. 10 illustrates a putter type golf club head 202 using the cylindrical, internal pin connector 150 on a hosel 230 that is designed to fit into the round shaft opening for connection thereof. As the other structures of this club head body 202 are similar to, or identical to, the club head body 102 described hereinabove, duplicative description is not provided in connection with club head body 202.

Figure 11:
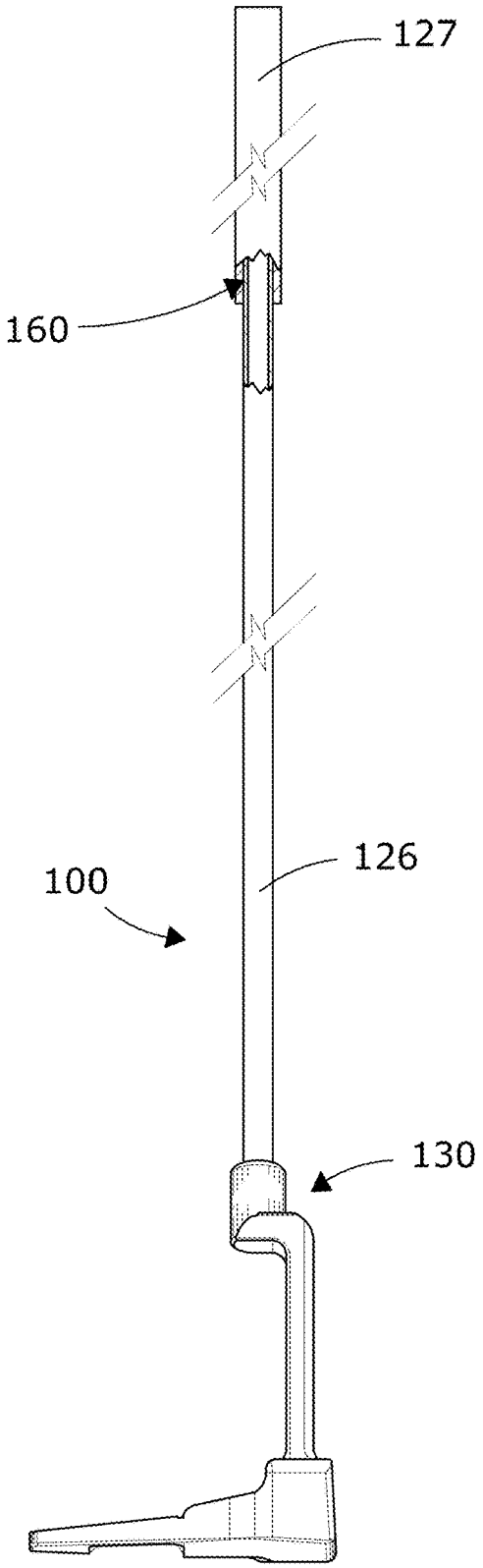
FIG. 11 is a toe side view of the putter type golf club illustrating relative orientation of the club head, the hosel, the shaft and the grip.

As shown in FIG. 11, the golf grip 127 of the putter 100 includes a central cavity 160 extending in the longitudinal direction of the club grip 127, the central cavity 160 extending about a central axis, wherein the central axis is not oriented diagonally relative to the club grip 127. The longitudinal axis of the shaft 126 is parallel to the central axis of the club grip 127 when positioned within the central cavity 160. Aligning the longitudinal axis of the shaft 126 and the central axis of the central cavity 160 allows any standard club grip to be interchangeably substituted on the putter 100. This is in contrast to other putters which require a diagonally oriented central cavity within the club grip when attempting to provide low or no torque putters. The hosel structure 130 disclosed herein enables the ability to use a wide variety of club grips with the putter 100.

The embodiments disclosed herein provide a unique shafting and hosel structure in line and toward the center of gravity CG of the club head to maintain the ball striking face of the golf club in a stable position toward an intended target during the entire execution of a conventional putting stroke by a golfer playing a game of golf. The stable, face to target position, does not require a need for the golfer to apply forces to the putter in an attempt to maintain the putter face square to the target during the putting stroke thereby eliminating an action that could result in the target being missed by the golf ball. This is accomplished using the disclosed hosel structure oriented in a reversed, onset position relative to the striking face of the putter.

As disclosed herein, the shaft is generally aimed at the center of gravity CG of the putter head body in a front to rear direction and is aimed in line, but offset slightly from the center of mass toward the toe in a heel to toe direction. This shaft orientation produces a balance of the putter that is slightly heavier at the heel portion of the putter head body. To illustrate this, it follows that when the shaft of the putter is balanced on a fulcrum located between the putter head and grip, the shafting and hosel structure creates a heel down, toe up orientation in the balanced putter orientation that, in turn, rotates the putter face in a counter clockwise direction until it faces forward in a way that easily can be aimed at a target or target line during a conventional putting stroke.

When the disclosed putter is used in the execution of putting stroke to strike a golf ball, the golfer's hands are located behind the face of the putter while the face of the putter head assumes a balanced position, whereby the face is initially aimed at the target. Because the putter is in a balanced position any tendency for the putter to rotate is eliminated and it then becomes effortless to maintain a constant alignment to an intended target line during an entire path of a putting stroke. The constant and consistent alignment results in an extremely accurate club head path by a golfer executing a putting stroke to a desired target, typically the golf hole, and given the putter maintains a balanced and stable position there is no need for the golfer to adjust or manipulate the putter during the putting motion in order to keep the face square to the target.

In the disclosed embodiments, the shaft extends upwardly in a substantially straight-up orientation relative to the striking face of the club head body, such that the shaft does not lean toward the front or rear of the putter head, thereby positioning a golfer's hands behind the striking face of the putter and directly over the center of gravity CG of the putter.

In the disclosed embodiments, the hosel is oriented in a rearward orientation, or onset position, rather than a conventional offset position that locates the shaft forward and in front of the putter striking face. Because the onset position of the hosel is oriented in an unconventional rearward direction, as compared with conventional designs where the shaft socket is oriented forward and ahead of the putter face, the reverse orientation of the hosel permits the shaft to be aligned in the direction of the center of gravity CG of the putter head while maintaining a golfer's hands behind the striking face. This unconventional reverse offset is precisely oriented to have a dual effect. First, the hosel body secures the shaft so that the shaft is in a vertical position relative to the striking face of the putter and not angled forward as with conventional offset, plumber neck hosel structures. Secondly, the hosel structure allows the shaft to be aligned toward the center of mass head of the putter head. The toe-ward alignment of the shaft causes the heel side of the putter head body to be heavier and the toe side to be lighter. This results in the putter to hang directly downward when balanced causing the face to point forward perpendicular at the target instead of straight upward as with conventional face balanced putters or in various degrees of toe hang as with other conventional putters that are not face balanced. It will be appreciated that the unique hosel structure aims the shaft connector and the shaft to be aligned directly toward the CG while maintaining the balanced orientation of the putter head during the execution of a putting stroke.

The shafting orientation disclosed herein is such that a leading edge of the striking face extends forward of the shaft connection to the putter head body and the face aims forward when the shaft is balanced on a fulcrum. In addition, the reverse plumber type hosel body allows for and is adaptable with a broad variety of both conventional and non-conventional putter head shapes.

Advantageously, the putter disclosed herein provides a shafting configuration having a hosel structure to align a striking face of the putter in a forward direction toward an intended target when oriented in a static balanced condition.

Additionally, the disclosed shafting configuration facilitates a hosel to align the shaft toward a center of gravity CG of the putter head to maintain constant alignment of a ball striking face of the putter during a conventional putting stroke.

Additionally, the disclosure provides a golf putter having a shaft orientation in a vertical position relative to the striking face of the putter head.

Additionally, the disclosure provides a putter to accommodate a wide variety of head shape designs.

Additionally, the disclosure provides a putter where the shafting does not interfere with the alignment lines of the putter head.

Additionally, the disclosure provides a putter that positions the face forward of the shaft.

Additionally, the disclosure provides a putter structure that allows shafting of both right and left-handed shafted putters.

Additionally, the disclosure provides a putter structure that allows for a wide range of conventional shaft and grip configurations.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as explicitly limited by the foregoing description.

What is claimed is:

1. A putter type golf club comprising:

a club head body comprising a frontal ball striking face, a rear surface, a heel area, a toe area, an upper surface, and a bottom sole, wherein said club head body includes a center of gravity located on a forward one-third thereof, relative to a distance between the frontal ball striking face and the rear surface, and between the toe area and the heel area;

a shaft for connection to a club grip at an upper end of said shaft, said shaft extending longitudinally about a longitudinal axis of the shaft which is oriented to intersect the club head body at an intersection point on the club head body that is between the center of gravity and a point toe-ward of the center of gravity, wherein the intersection point is located at a distance no greater than 0.5 inches away from the center of gravity, wherein said longitudinal axis of said shaft is aligned to intersect the club head body at a forward one-third of the mass of the club head body; and a hosel connecting said shaft to said club head body at a heel-ward one-fourth of a distance between a heel end and a toe end of the club head body, wherein the hosel comprises:

an upwardly extending arm connected to the upper surface of the club head body at the heel area and between said frontal ball striking face and said rear surface, the upwardly extending arm of the hosel extending parallel to a plane defined by the frontal ball striking face of the club head body, the upwardly extending arm of the hosel extending perpendicularly relative to the upper surface of the club head body;

an onset extension connected to a top end of the upwardly extending arm, the onset extension extending rearwardly away from the upwardly extending arm in a direction parallel to said upper surface of the club head body; and a shaft connector at a rearward end of the onset extension for connecting the shaft to the hosel in a position that disposes the entire shaft rearward of a plane defined by the frontal ball striking face of the club head body.

2. The putter type golf club of claim 1, wherein said shaft connector is a shaft socket defined by an opening sized to receive said shaft and connect said shaft to said hosel.

3. The putter type golf club of claim 1, wherein said shaft connector is a pin sized to fit into said shaft, whereby said shaft fits over said pin when connected to said hosel.

4. The putter type golf club of claim 1, further comprising a central cavity extending in the longitudinal direction of the club grip, the central cavity extending about a central axis of the club grip, wherein the central axis is not oriented diagonally relative to the club grip, wherein the longitudinal axis of the shaft is parallel to the central axis of the club grip.

* * * * *